US010247198B2

(12) United States Patent
Fujiwara et al.

(10) Patent No.: US 10,247,198 B2
(45) Date of Patent: Apr. 2, 2019

(54) COMPRESSOR HOUSING

(71) Applicant: HONDA MOTOR CO., LTD., Tokyo (JP)

(72) Inventors: Akihiko Fujiwara, Wako (JP); Atsushi Shimizu, Wako (JP); Shota Kadokura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/668,744

(22) Filed: Aug. 4, 2017

(65) Prior Publication Data

US 2018/0038387 A1 Feb. 8, 2018

(30) Foreign Application Priority Data

Aug. 4, 2016 (JP) ..... 2016-153943

(51) Int. Cl.
*F04D 29/42* (2006.01)
*F04D 29/40* (2006.01)
(Continued)

(52) U.S. Cl.
CPC ..... *F04D 29/403* (2013.01); *F04D 29/4213* (2013.01); *F02B 33/36* (2013.01);
(Continued)

(58) Field of Classification Search
None
See application file for complete search history.

(56) References Cited

U.S. PATENT DOCUMENTS 9,003,791 B2 * 4/2015 Ibaraki ..... F01M 13/021 123/568.17
9,528,431 B2 * 12/2016 Palko ..... F02B 37/16
(Continued)

FOREIGN PATENT DOCUMENTS

DE 10 2016 211 581 A1 1/2017
JP 2005-226505 A 8/2005
(Continued)

OTHER PUBLICATIONS

Search Report dated May 7, 2018, issued in counterpart German Application No. 10 2017 213 584.0, with English translation (14 pages).

*Primary Examiner* — Jason D Shanske
*Assistant Examiner* — Theodore C Ribadeneyra
(74) *Attorney, Agent, or Firm* — Westerman, Hattori, Daniels & Adrian, LLP

(57) ABSTRACT

The object is to provide a compressor housing which can suppress blowback of oil. A compressor housing (1) is used in a compressor which uses a compressor impeller (5) provided in an intake air flow path more to a downstream side than a blow-by gas inlet. The compressor housing (1) includes an impeller chamber (2), and an intake air duct (6) which extends along an axis line (C). The duct (6) includes an inner-wall face (61). A step part (67) that is arc shaped along a circumferential direction of the impeller (5) and has a distance along the radial direction of the impeller (5) from the axis line (C) that is farther at a downstream side than at an upstream side thereof is formed in the inner-wall face (61) more to an upstream side along the axis line (C) than the intake air inlet (22).

14 Claims, 9 Drawing Sheets

(51) Int. Cl.

| | |
|---|---|
| *F02B 33/36* | (2006.01) |
| *F02B 39/14* | (2006.01) |
| *F02M 35/10* | (2006.01) |
| *F02M 35/104* | (2006.01) |

(52) U.S. Cl.
CPC ..... *F02B 39/14* (2013.01); *F02M 35/1042* (2013.01); *F02M 35/10157* (2013.01); *F02M 2700/331* (2013.01); *F05D 2220/40* (2013.01); *F05D 2260/607* (2013.01)

(56) References Cited

U.S. PATENT DOCUMENTS 9,567,942 B1* 2/2017 Krivitzky ..... F02K 1/36
2002/0192073 A1* 12/2002 Japikse ..... F04D 27/0207 415/169.1
2005/0152775 A1* 7/2005 Japikse ..... F01D 5/143 415/1
2007/0266705 A1* 11/2007 Wood ..... F02B 37/22 60/599
2010/0205949 A1* 8/2010 Bolda ..... B01D 46/12 60/309
2011/0011084 A1* 1/2011 Yanagida ..... F02M 35/084 60/605.2
2011/0048003 A1* 3/2011 Chen ..... F04D 25/04 60/605.2
2011/0173954 A1* 7/2011 Wenzel ..... F02M 25/0722 60/274
2012/0201655 A1* 8/2012 Kusakabe ..... F01D 9/026 415/116
2014/0050576 A1* 2/2014 Li ..... F04D 29/4206 415/204
2014/0105736 A1* 4/2014 Kiriaki ..... F04D 29/441 415/182.1
2015/0159664 A1* 6/2015 Olin ..... F02C 7/045 415/58.2
2015/0192147 A1* 7/2015 An ..... F04D 29/4213 415/58.4
2015/0198163 A1* 7/2015 Lei ..... F04D 17/105 415/207

FOREIGN PATENT DOCUMENTS

JP 2010-216376 A 9/2010
JP 2011047358 A * 3/2011

* cited by examiner

COMPRESSOR HOUSING

This application is based on and claims the benefit of priority from Japanese Patent Application No. 2016-153943, filed on 4 Aug. 2016, the content of which is incorporated herein by reference.

BACKGROUND OF THE INVENTION

Field of the Invention

The present invention relates to a compressor housing. In detail, it relates to the structure of a compressor housing including an impeller chamber and an intake air duct.

Related Art in the supercharging system of an internal combustion engine, the intake air supplied to the internal combustion engine is pressurized by rotationally driving a compressor provided to the intake flow path of the internal combustion engine using the exhaust gas energy of the internal combustion engine and electrical energy. The compressor includes a compressor impeller, and a compressor housing in which an impeller chamber housing the compressor impeller and an intake air duct guiding intake air to this impeller chamber are formed. In addition, the supercharging system of an internal combustion engine includes an air-flow meter that detects the flowrate of intake air in the intake air flow path at an upstream side from the compressor, and controls the flowrate of intake air supplied for combustion in the internal combustion engine using this air-flow meter.

Incidentally, the mixed gas or exhaust gas flowing out in the crankcase of the internal combustion engine (hereinafter these are referred to as "blow-by gas") is recirculated within the intake air flow path via the breather flow path, to suppress the discharge of the blow-by gas. In addition, as shown in Japanese Unexamined Patent Application, Publication No. 2005-226505, for example, in a supercharging system including the above such compressor, it is often the case that the blow-by gas is in the intake air flow path at a downstream side from the air-flow meter, and recirculates to upstream from the compressor impeller.

SUMMARY OF THE INVENTION

FIG. 9 is a time chart showing a representative example of an operating pattern in which backflow of oil explained below can occur. FIG. 9 shows a case of releasing the accelerator pedal at t1 to minimize the load on the internal combustion engine, from a state of continually stepping on the accelerator pedal from time t0 to maximize the load on the internal combustion engine, and then subsequently maximizing the load on the internal combustion engine again by stepping on the accelerator pedal at time t2.

FIG. 10 is a view showing an aspect of the inside of a conventional compressor housing 100. More specifically, FIG. 10 is a photograph when viewing, from an upstream side of intake air, a compressor impeller 102 provided inside of an intake air duct 101 of a compressor housing 100 immediately after performing steady operation which makes the load of the internal combustion engine constant at a maximum under the operating pattern shown in FIG. 9, i.e. immediately after time t1 in FIG. 9.

When performing steady operation of the internal combustion engine, the intake air in the intake air duct 101 is paddled into the impeller chamber from the intake air inlet 103 due to the compressor impeller 102 rotating clockwise in FIG. 10. At this time, as shown by the dotted-line arrow 104, swirl flow in the same direction as the rotational direction of the compressor impeller 102 is produced from the upstream side to the downstream side along the inner-wall face of the intake air duct 101, around the intake air inlet 103 of the impeller chamber. Although most of the oil in the blow-by gas adhering to the inner-wall face of the intake air duct 101 is aspirated into the intake air inlet 103 by this swirl flow, a part may continue swirling around the intake air inlet 103 without being aspirated into the intake air inlet 103. Therefore, when the accelerator pedal is released from a state performing steady operation, and the load on the internal combustion engine is decreased, the swirl flow around the intake air inlet 103 becomes weak, the oil adhered to the inner-wall face collects at the bottom of the intake air duct 101, and an oil pool 105 may be formed as shown in FIG. 10 (corresponding to period of time t1 to t2 in time chart of FIG. 9).

In addition, when the accelerator pedal is stepped on again, although the flowrate of intake air from within the intake air duct 101 into the impeller chamber suddenly increases, surging occurs due to the rapid pressure change within the compressor housing 100 at this time, and a strong swirl flow from the side of the compressor impeller 102 towards the upstream side may be produced inside of the intake air duct 101. Therefore, upon such repeat acceleration, if the oil pool 105 exists within the intake air duct 101 as shown in FIG. 10, the oil of the oil pool 105 may be blown back from within the intake air duct 101 to the upstream side by the strong swirl flow, and oil may adhere to the air-flow meter on the upstream side.

The present invention has an object of providing a compressor housing that can suppress the blowback of oil in the blow-by gas to the intake air upstream side.

According to a first aspect of the present invention, a compressor housing (e.g., the compressor housing 1 described later) is used in a compressor (e.g., the compressor 92C described later) that uses an impeller (e.g., the compressor impeller 5 described later) provided in an intake air flow path of the internal combustion engine more to a downstream side than a blow-by gas recirculation part (e.g., the blow-by gas inlet 83 described later) in which blow-by gas of the internal combustion engine recirculates, to pressurize intake air flowing through the intake air flow path The compressor housing includes: an impeller chamber (e.g., the impeller chamber 2 described later) that houses the impeller to be rotatable, and an intake air duct (e.g., the intake air duct 6 described later) that extends along an axis line (e.g., the axis line C described later) of the impeller and introduces intake air to the impeller chamber, in which the intake air duct includes an inner-wall face (e.g., the inner-wall face 61 described later) that connects with an intake air inlet (e.g., the intake air inlet 22 described later) formed in the impeller chamber, and in which a step part (e.g., the step part 67 described later) that is arc shaped along a circumferential direction of the impeller and has a distance along the radial direction of the impeller from the axis line that is farther at a downstream side than at an upstream side thereof is formed in the inner-wall face more to an upstream side along the axis line than the intake air inlet.

According to a second aspect of the present invention, in this case, it is preferable for the compressor housing to further include a breather duct (e.g., the breather duct 8 described later) that extends in the radial direction of the impeller and introduces blow-by gas into the intake air duct.

According to a third aspect of the present invention, in this case, it is preferable for the blow-by gas inlet (e.g., the blow-by gas inlet 83 described later) connecting an inner circumferential face (e.g., the inner circumferential face 82 described later) of the breather duct and the inner-wall face to be provided vertically above the intake air inlet in an equipped orientation of the compressor housing, and a connecting face (e.g., the connecting face 66 described later) in the inner-wall face that connects the blow-by gas inlet and the intake air inlet to be substantially perpendicular relative to the axis line.

According to a fourth aspect of the present invention, in this case, it is preferable for a recess (e.g., the recess 65 described later) to be formed in the inner-wall face at a portion adjacent to the intake air inlet of a base (e.g., the base 64 described later) serving as a bottom in an equipped orientation of the compressor housing, and the step part to be formed more to an upstream side along the axis line than the recess.

According to a fifth aspect of the present invention, in this case, it is preferable for the step part to be formed in the inner-wall face at a portion other than the base.

According to a sixth aspect of the present invention, in this case, it is preferable for the step part to extend along the circumferential direction to a side of the blow-by gas inlet from a position, which is higher than a lowest point (e.g., the lowest point 221 described later) of the intake air inlet, on the inner-wall face at a lateral part in the equipped orientation of the compressor housing.

According to a seventh aspect of the present invention, a compressor housing is used in a compressor that uses an impeller provided in an intake air flow path of the internal combustion engine more to a downstream side than a blow-by gas recirculation part in which blow-by gas of the internal combustion engine recirculates, to pressurize intake air lowing through the intake air flow path The compressor housing includes an impeller chamber that houses the impeller to be rotatable, and an intake air duct that extends along an axis line of the impeller and introduces intake air to the impeller chamber, in which the intake air duct includes an inner-wall face that connects with an intake air inlet formed in the impeller chamber, and in which a groove (e.g., the groove 68 described later) extending along the radial direction of the impeller from a position, which is higher than a lowest point of the intake air inlet, on a circumferential edge of the intake air inlet that in the equipped orientation of the compressor housing, is formed in the inner-wall face more to an upstream side along the axis line than the intake air inlet.

According to an eighth aspect of the present invention, in this case, it is preferable for the compressor housing to further include a recirculation duct (e.g., the EGR duct 7 or breather duct 8 described later) that extends along a radial direction of the impeller and introduces blow-by gas or exhaust gas into the intake air duct, and the groove to extend from a circumferential edge of the intake air inlet to a side of an inner circumferential face of the recirculation duct.

According to an ninth aspect of the present invention, in this case, it is preferable for a recirculation opening (e.g., the EGR inlet 73 described later) that connects the inner circumferential face of the recirculation duct and the inner-wall face to be provided at a position higher than the intake air inlet at an equipped orientation of the compressor housing, and for the groove to extend from a circumferential edge top part (e.g., the apex 222 described later) of the intake air inlet to a side of the inner circumferential face of the recirculation duct.

The compressor housing according to the first aspect of the present invention forms an arc-shaped step part along the circumferential direction of the compressor impeller, more to the upstream side along the axis line than the intake air inlet in the inner circumferential face of the intake air duct thereof. In addition, this step part has a distance along the radial direction of the impeller from the axis line that is farther at the downstream side than the upstream side. In other words, this step part serves as a barrier to oil running along the inner-wall face to flow from the intake air downstream side to the upstream side. Therefore, since the step part serves as a barrier relative to the flow of oil running along the inner-wall face, even when strong swirl flow is produced from the downstream side towards the upstream side within the intake air duct in a state in which oil has collected in the vicinity of the intake air inlet within the intake air duct as mentioned above, it is possible to suppress oil from overcoming the step part and blowing back further to the upstream side. In addition, it is thereby possible to prevent a sensor such as the air-flow meter provided on the upstream side from the intake air duct 6 from being dirtied by oil.

The second aspect of the present invention provides the breather duct extending along the radial direction of the impeller to the compressor housing in which the intake air duct is provided, and recirculates the blow-by gas from this breather duct into the intake air duct. A swirl flow is produced inside the intake air duct as mentioned above. For this reason, with a conventional compressor housing, when recirculating blow-by gas within the intake air duct of the compressor housing, oil tends to collect within the intake air duct, and the problem of blowback of oil to the intake air upstream side is more remarkably exhibited. In contrast, with the present invention, since the outward flow of oil to upstream side is suppressed by the step part formed in the intake air duct, even if recirculating blow-by gas within the intake air duct of the compressor housing, the problem of blowback of oil as mentioned above will not actualize.

With the compressor housing according to the third aspect of the present invention, the blow-by gas inlet is provided vertically above the intake air inlet in the equipped orientation thereof, and further, the connecting face which connects this blow-by gas inlet and the intake air inlet in the inner-wall face of the intake air duct is substantially perpendicular to the axis line. The distance between the blow-by gas inlet and the intake air inlet can thereby be made as short as possible. The oil in the blow-by gas flowing in from the blow-by gas inlet runs along the connecting face to fall down to the intake air inlet by way of its own weight. Herein, in the case of irregularities existing at the connecting face between the blow-by gas inlet and the intake air inlet, due to the swirl flow while the oil falls down from the blow-by gas inlet to vertically downwards, the path thereof may veer away to around the intake air inlet. In contrast, with the present invention, by establishing the connecting face to be substantially perpendicular relative to the axis line, since it is possible to pour most of the oil in the blow-by gas into the intake air inlet, it is possible to reduce the amount of oil collecting inside the intake air duct, and possible to further suppress blowback of oil.

With the compressor housing according to the fourth aspect of the present invention, the step part serving as a barrier to oil as mentioned above is formed in the inner-wall face of the intake air duct more to an upstream side along the axis line than the recess formed in the base serving as the bottom in the equipped orientation. As explained by referencing FIG. 10, the oil inside the intake air duct tends to collect in such a recess. Therefore, by providing the step part more to the upstream side than the recess which forms this oil pool, it is possible to suppress the outward flow to further upstream side by this step part, even if oil collected in the recess is flowed to the upstream side by a strong reverse swirl flow as mentioned above.

With the compressor housing according to the fifth aspect of the present invention, the step part is formed in a portion other than the base of the inner-wall face. Since the step part serves as a barrier relative to oil flowing back from the downstream side to the upstream side as mentioned above, if forming such a step part at the base, there is a risk of the amount of oil collecting at the base increasing. In contrast, according to the present invention, by forming the step part at a portion other than the base, it is possible to suppress the outward flow to the upstream side thereof, without increasing the amount of oil collecting inside the intake air duct.

With the compressor housing according to the sixth aspect of the present invention, the step part extends along the circumferential direction of the impeller to the side of the blow-by gas inlet provided vertically above the intake air inlet from a position, which is higher than the lowest point of the intake air inlet, on a lateral part in the equipped orientation of the inner-wall face. When the aforementioned such strong reverse swirl flow is produced, the oil collected in the vicinity of the lowest point of the intake air inlet thereby flows from the side of the base along the step part to the side of the blow-by gas inlet which is vertically above, and runs along the connecting face formed to be substantially perpendicular to the axis line and flows into the intake air inlet as mentioned above. Therefore, according to the present invention, it is possible to flow the oil collected at the base into the intake air inner, while configuring so as not to blow back to the upstream side.

The compressor housing according to the seventh aspect of the present invention forms the groove extending along the radial direction of the impeller from a position, which is higher than the lowest point of the intake air inlet in the equipped orientation, on the circumferential edge of the intake air inlet, more to an upstream side along the axis line of the impeller than the intake air inlet in the inner-wall face of the intake air duct thereof. As explained by referencing FIG. 10, while performing steady operation of the internal combustion engine, swirl flow is produced inside of the intake air duct from the upstream side to the downstream side, whereby the oil in the blow-by gas may continue to swirl around the intake air inlet, and when the accelerator pedal is released, the oil may collect in the vicinity of the lowest point of the intake air inlet. The groove of the present invention is substantially perpendicular to the flowing direction of oil around the intake air inlet during such steady operation. Therefore, for the oil swirling and moving along the circumferential direction of the impeller around the intake air inlet in the inner-wall face of the intake air duct, at this groove, the traveling direction thereof is changed to the extending direction of the groove, i.e. radial direction of the impeller, and as a result, the oil spreads along the groove. In other words, according to the present invention, since it is thereby possible to temporarily cause the oil swirling around the intake air inlet during steady operation to evacuate to this groove, it is possible to reduce the amount of oil collecting in the vicinity of the lowest point of the intake air inlet upon releasing the accelerator pedal. Consequently, according to the present invention, it is possible to reduce the amount of oil blown back from the upstream side to the downstream side when a strong swirl flow is produced from the downstream side towards the upstream side inside the intake air duct. In addition, it is thereby possible to prevent a sensor such as the air-flow meter provided on the upstream side of the intake air duct from being dirtied by oil.

The groove according to the eighth aspect of the present invention includes a function of causing oil to temporarily evacuate as mentioned above; however, in order to configure to be able to evacuate sufficient oil, a certain length is required. With the present invention, the recirculation duct extending along the radial direction of the impeller and introducing blow-by gas or exhaust gas into the intake air duct is provided to the compressor housing to which the intake air duct is provided, and the groove extends from the circumferential edge of the intake air duct to the side of the inner circumferential face of the recirculation duct. In other words, with the present invention, it is possible to cause a sufficient amount of oil to evacuate to the groove, by providing the groove using the space formed by providing the recirculation duct.

With the compressor housing according to the ninth aspect of the present invention, the groove extends from the circumferential edge top part of the intake air inlet in the equipped orientation to the side of the inner circumferential face of the recirculation duct. The oil temporarily evacuating to the groove by way of the swirl flow during steady operation as mentioned above, when releasing the accelerator pedal, runs along the groove to flow into the intake air inlet further below; therefore, it is possible to reduce the amount of oil collecting in the vicinity of the lowest point of the intake air inlet.

DETAILED DESCRIPTION OF THE INVENTION

Figure 1:
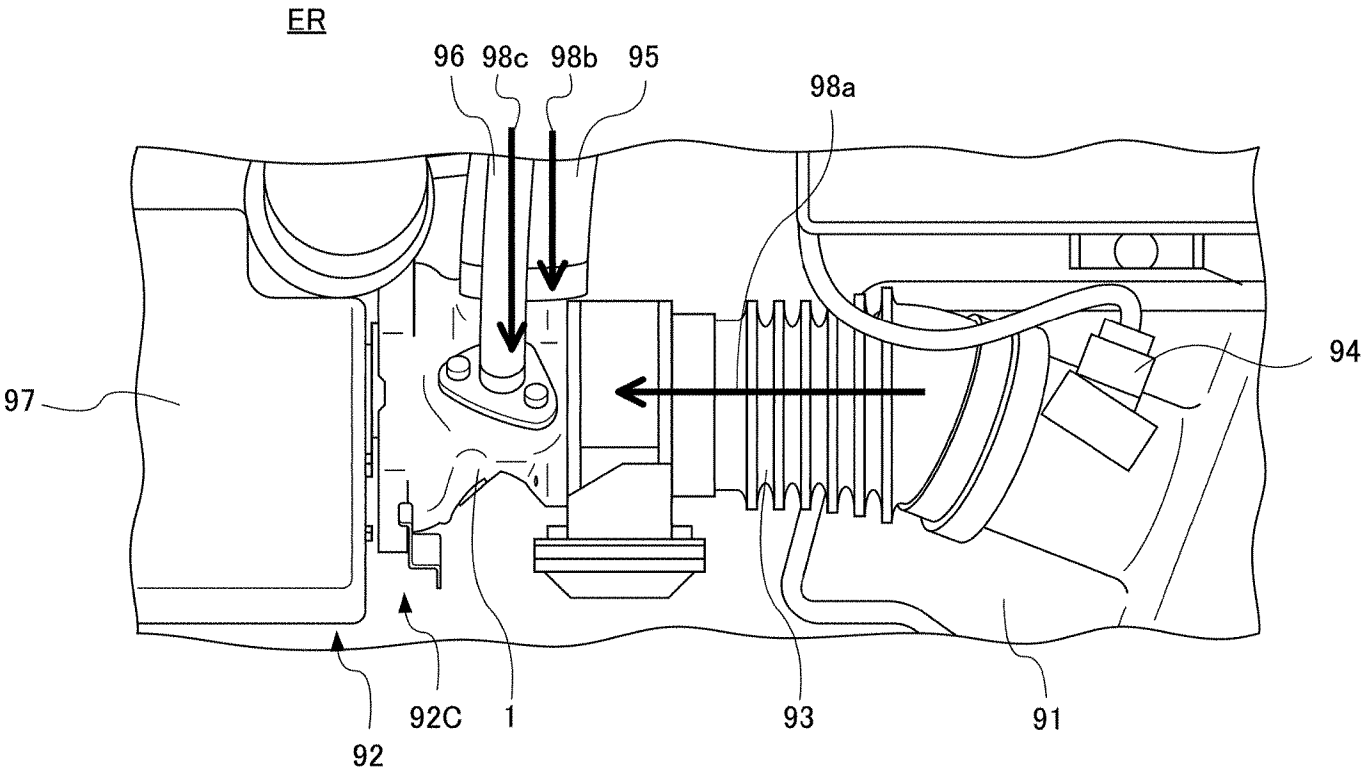
FIG. 1 is a plan view of an engine room of a vehicle to which a compressor housing according to an embodiment of the present invention is applied.

Hereinafter, an embodiment of the present invention will be explained while referencing the drawings. FIG. 1 is a plan view of an engine room ER of a vehicle equipped with a turbocharging system S of an internal combustion engine (hereinafter referred to as "engine"). FIG. 1 mainly shows devices constituting the intake air system of the turbocharger system S, among the various devices provided in the engine room ER. In other words, FIG. 1 is a drawing when viewing, from above in the vertical direction, the turbocharger system S in a state equipped at a predetermined equipped orientation in the engine room ER.

The turbocharging system S includes an air-cleaner box 91 that purifies the ambient air; a turbocharger 92 that includes an exhaust turbine which converts the exhaust gas energy into the mechanical energy of a rotating shaft, and a compressor 92C that pressurizes the intake air using a compressor impeller described later, which is coupled to the rotating shaft; intake air plumbing 93 that connects the air-cleaner box 91 and the compressor 92C; an air-flow meter 94 that detects the flowrate of intake air flowing in the intake air plumbing 93; EGR plumbing 95 that connects the compressor 92C and an exhaust flow path of the engine which is not illustrated; and breather plumbing 96 that connects the compressor 92C and the crankcase of the engine which is not illustrated. It should be noted that FIG. 1 shows a state in which the exhaust turbine of the turbocharger 92 is covered by a plate-like cover member 97.

The intake air plumbing 93 extends substantially horizontally at the equipped orientation thereof to connect the air-cleaner box 91 and the intake air duct described later, which is formed at the compressor housing 1 constituting the main body of the compressor 92. Inside of the compressor housing 1, the main flow of intake air purified by the air-cleaner box 91 flows in the direction shown by the arrow 98*a* in FIG. 1 by way of this intake air plumbing 93. The air-flow meter 94 is provided in the intake air plumbing 93 at a position closer to the air-cleaner box 91 than the compressor housing 1.

The EGR plumbing 95 connects the exhaust flow path (not illustrated) and an EGR duct described later, which is formed at the compressor housing 1. Part of the exhaust gas of the engine (hereinafter referred to as "EGR gas") thereby flows inside of the compressor housing 1 in a direction substantially perpendicular to the main flow of intake air shown by the arrow 98*a*, as shown by the arrow 98*b* in FIG. 1.

The breather plumbing 96 connects the crankcase (not illustrated) and a breather duct described later, which is formed in the compressor housing 1. Blow-by gas thereby flows inside of the compressor housing 1 in a direction substantially perpendicular to the main flow of intake air shown by the arrow 98*a*, as shown by the arrow 98*c* in FIG. 1.

In addition, in the turbocharger system 8, an EGR gas recirculation part (i.e. EGR duct 7 described later) in which EGR gas is recirculated, and a blow-by gas recirculation part (i.e. breather duct 8 described later) in which blow-by gas is recirculated are provided in the intake air flow path constituted by the air-cleaner box 91, intake air plumbing 93 and compressor housing 1, more to a downstream side than the air-flow meter 94.

Figure 2:
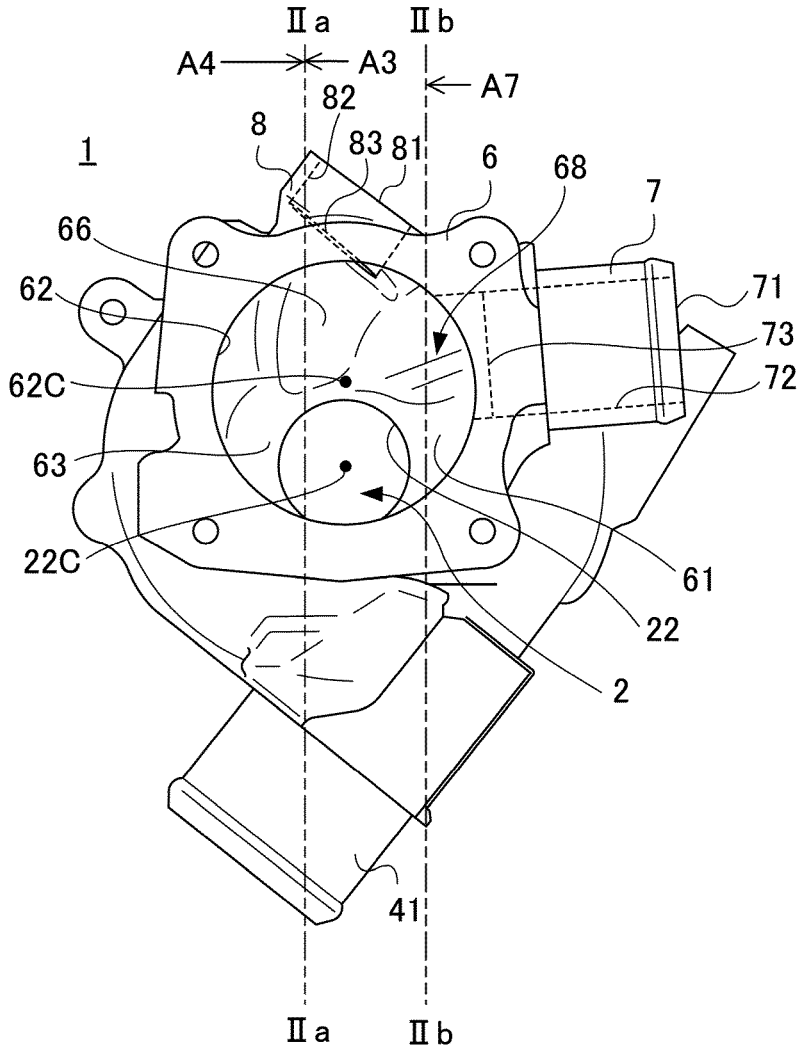
FIG. 2 is a front view of the compressor housing according to the embodiment.
Figure 3:
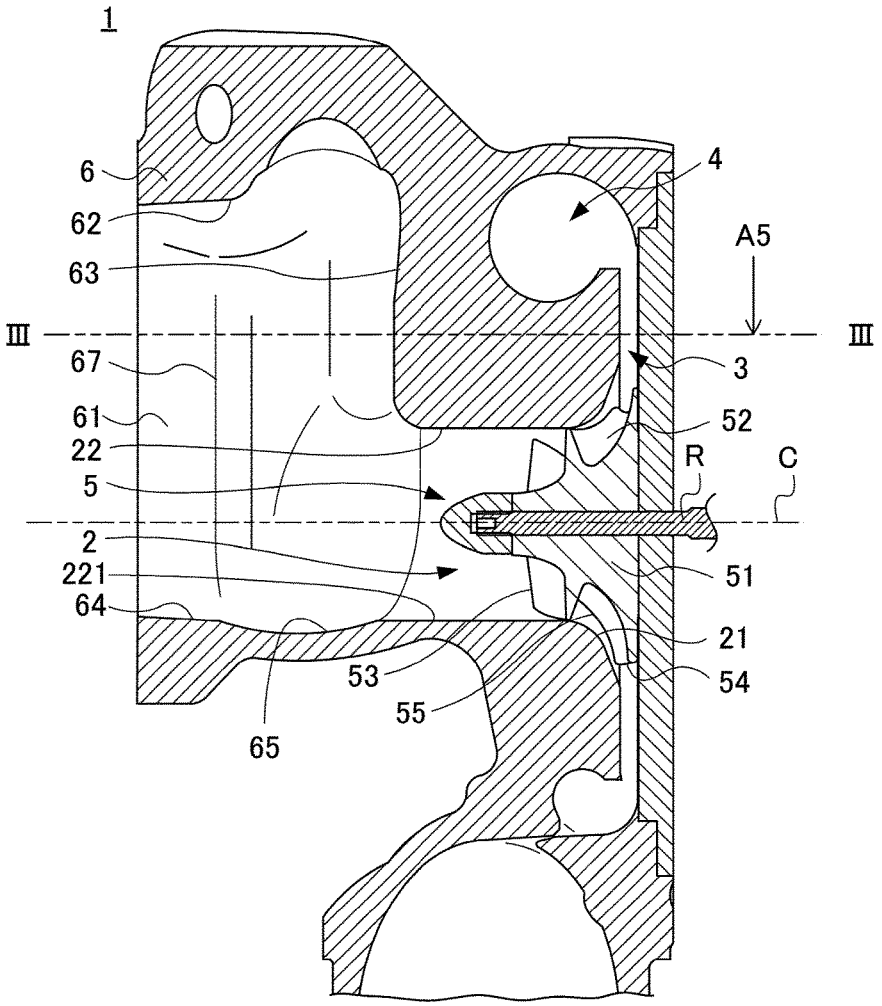
FIG. 3 is a cross-sectional view of the compressor housing according to the embodiment.

FIG. 2 is a front view of the compressor housing 1. More specifically, FIG. 2 is a drawing when viewing the compressor housing 1 from an intake air upstream side along the axis line of the compressor impeller, which is provided to be rotatable inside of the impeller chamber 2 described later. FIG. 3 is a cross-sectional view of the compressor housing 1. More specifically, FIG. 3 is a drawing when viewing the cross section of the compressor housing 1 along the line IIa-IIa in FIG. 2 in the direction of the arrow A3. It should be noted that FIG. 2 and FIG. 3 are drawings when viewing the compressor housing 1 at the equipped orientation from the side. In other words, the up/down directions in FIG. 2 and FIG. 3 equal the vertical direction of the compressor housing 1 at the equipped orientation thereof.

The compressor housing 1 includes the impeller chamber 2 which houses the compressor impeller 5 to be rotatable about the rotating shaft R; a diffuser chamber 3; a scroll flow path 4; an intake air duct 6 to which the intake air plumbing 93 (refer to FIG. 1) is connected, and introduces intake air to the impeller chamber 2; the EGR duct 7 to which the EGR plumbing 95 (refer to FIG. 1) is connected, and introduces EGR gas into the intake air duct 6; and the breather duct 8 to which the breather plumbing 96 (refer to FIG. 1) is connected, and introduces breather gas into the intake air duct 6.

The compressor impeller 5 includes a wheel 51 coupled to the rotating shaft R that is rotationally driven by the exhaust turbine, and a plurality of blades provided to a conical hub face of this wheel 51. Each of the blades 52 is provided at equal intervals along the circumferential direction on the hub face of the wheel 51. Each of the blades 52 is a plate shape that extends at a predetermined angular distribution from a leading edge 53, which is the inlet of intake air, towards a trailing edge 54, which is the outlet of intake air. A tip end 55 of each blade 52 is formed along a surface profile of a shroud 21 described later, which opposes the compressor impeller 5 when housed inside of the impeller chamber 2.

The shroud 21, which covers a lateral part of the compressor impeller 5, is formed in the impeller chamber 2. The shroud 21 includes a shroud face of a shape following the tip edges 55 from the leading edge 53 until the trailing edge 54 of the compressor impeller 5, and more specifically, a shroud face of a shape substantially matching the enveloping surface formed by the tip edges 55, when the compressor impeller 5 rotates around the rotating shaft R, and the shroud 21 covers the tip edges 55, which are the lateral part of the compressor impeller 5 by way of this shroud face. A side at the leading edge 53 of this shroud 21 forms an intake air inlet 22 having an inside diameter substantially equal to the outside diameter of this leading edge 53. In addition, a side at the trailing edge 54 of the shroud 21 forms an annular intake air discharge opening having a width substantially equal to the height of this trailing edge 54.

The compressor impeller 5 rotates clockwise when viewing from the intake air upstream side around the rotating shaft R (i.e. clockwise in FIG. 2), for example, when the turbine impeller of the exhaust turbine coupled by the rotating shaft R with this rotates by way of the energy of exhaust gas. When the compressor impeller 5 rotates in a state provided inside the impeller chamber 2, there is influx along the axis line C from the leading edge 53 of each blade 52, which flows between the respective blades 52, and then is discharged from each of the trailing edges 54 towards the outside in the radial direction.

The diffuser chamber 3 is annular, and is formed so as to surround the intake air discharge opening of the impeller chamber 2. A raw of linear vanes provided to stand is formed at predetermined intervals along the circumferential direction of the compressor impeller 5 in the diffuser chamber 3. By the compressor impeller 5 rotating, the intake air discharged from the trailing edge 54 thereof to the outside in the radial direction is decelerated in the course of flowing while expanded along the vane row formed in the diffuser chamber 3.

The scroll flow path 4 is annular, and is formed so as to surround the diffuser chamber 3. The flow path cross-sectional area of the scroll flow path 4 becomes gradually larger along the same direction as the rotational direction of the compressor impeller 5. The intake air discharged from the diffuser chamber 3 to outside in the radial direction, after further decelerated in the course of flowing through the scroll flow path 4, is guided to the combustion chamber of the engine (not illustrated) via the intake air discharge duct 41 (refer to FIG. 2).

The intake air duct 6 is substantially tubular extending along the axis line C of the compressor impeller 5. The intake air duct 6 includes an inner-wall face 61 that connects to the intake air inlet 22 formed at the impeller chamber 2. The intake air introduced by the intake air plumbing 93 in FIG. 1 is introduced into the impeller chamber 2 along the axis line C via the intake air flow path formed by the inner-wall face 61 of this intake air duct 6.

As shown in FIGS. 2 and 3, the inner-wall face 61 of the intake air duct 6 is configured by a substantially cylindrical inner circumferential face 62 having a larger inside diameter than the inside diameter of the intake air inlet 22 of the impeller chamber 2 and extending along the axis line C; and an annular shoulder face 63 that extends along the radial direction of the compressor impeller 5 to connect the inner circumferential face 62 and the intake air inlet 22 having a smaller diameter than this. In addition, as shown in FIG. the center 62C of the inner circumferential face 62 when viewing along the axis line C of the compressor impeller 5 at the equipped orientation is eccentric to somewhat above in the vertical direction relative to the center 22C of the intake air inlet 22 of the impeller chamber 2. It should be noted that the specific configuration of this inner-wall face 61 will be explained in detail while referencing cross-sectional views later.

The EGR duct 7 is a pipe member that communicates a plumbing connection part 71 provided at the outside of the compressor housing 1 and the intake air flow path formed by the inner-wall face 61 on the inside of the intake air duct 6. The aforementioned EGR plumbing 95 (refer to FIG. 1) is connected to this plumbing connection part 71. The EGR gas is thereby recirculated within the intake air duct 6. The inner circumferential face 72 of the EGR duct 7 is substantially cylindrical, and extends along the radial direction of the compressor impeller 5. When defining an opening connecting the inner circumferential face 72 of this EGR duct 7 and the inner-wall face 61 of the intake air duct 6 as an EGR inlet 73, the center of this EGR inlet 73 is provided at a position higher than the center 22C of the intake air inlet 22, at the equipped orientation of the compressor housing 1 as shown in FIG. 2.

The breather duct 8 is a pipe member communicating a plumbing connection part 81 provided outside of the compressor housing 1 and the intake air flow path formed by the inner-wall face 61 at the inside of the intake air duct 6. The aforementioned breather plumbing 96 (refer to FIG. 1) is connected to this plumbing connection part 81. The blow-by gas is thereby recirculated within the intake air duct 6. The inner circumferential face 82 of the breather duct 8 is substantially cylindrical, and extends along the radial direction of the compressor impeller 5. When defining an opening connecting the inner circumferential face 82 of this breather duct 8 and the inner-wall face 61 of the intake air duct 6 as a blow-by gas inlet 83, this blow-by gas inlet 83 is provided above in the vertical direction the intake air inlet 22 at the equipped orientation of the compressor housing 1.

Figure 4:
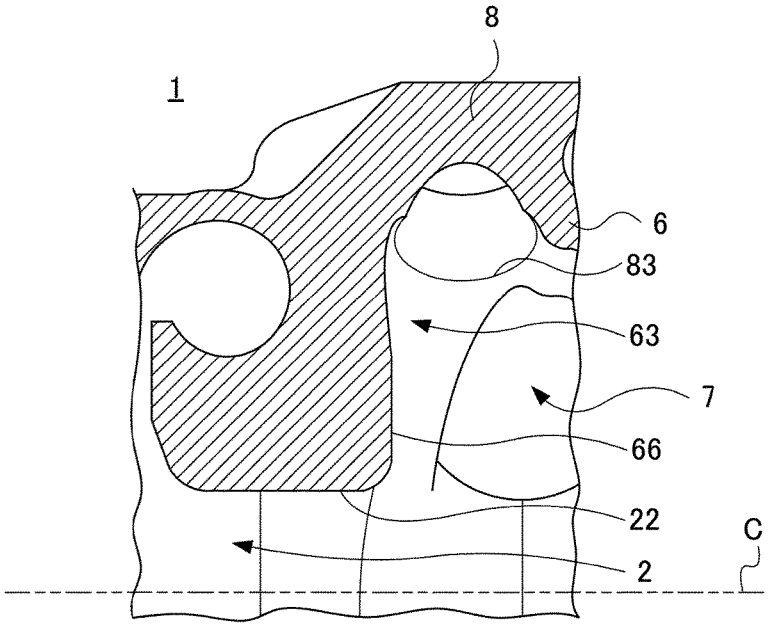
FIG. 4 is a cross-sectional view of the compressor housing according to the embodiment.

FIG. 4 is a cross-sectional view of the compressor housing 1. More specifically, FIG. 4 is a drawing when viewing the cross section of the compressor housing 1 along the line IIa-IIa in FIG. 2 in the direction of the arrow A4. A connecting face 66 of the shoulder face 63 of the intake air duct 6 connects the intake air inlet 22 and the blow-by gas inlet 83 provided vertically above this. The connecting face 66 is substantially perpendicular to the axis line C as shown in FIG. 4. In other words, irregularities serving as a barrier to oil flowing along the wall face are not provided to the connecting face 66 which connects the blow-by gas inlet 83 and the intake air inlet 22. The distance between the blow-by gas inlet 83 and the intake air inlet 22 can thereby be made as short as possible. In addition, most of the oil in the blow-by gas recirculated within the intake air duct 6 from the blow-by gas inlet 83 can be made to run along the connecting face 66 by its own weight and be aspirated into the intake air inlet 22.

Figure 9:
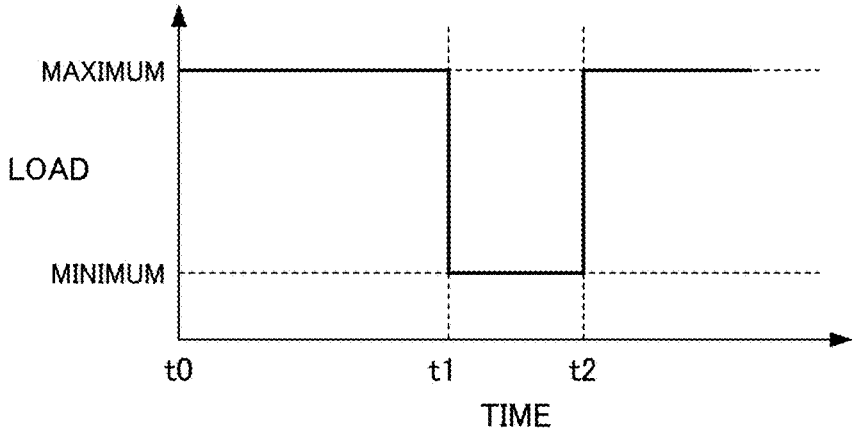
FIG. 9 is a time chart for explaining a problem of the present invention.
Figure 10:
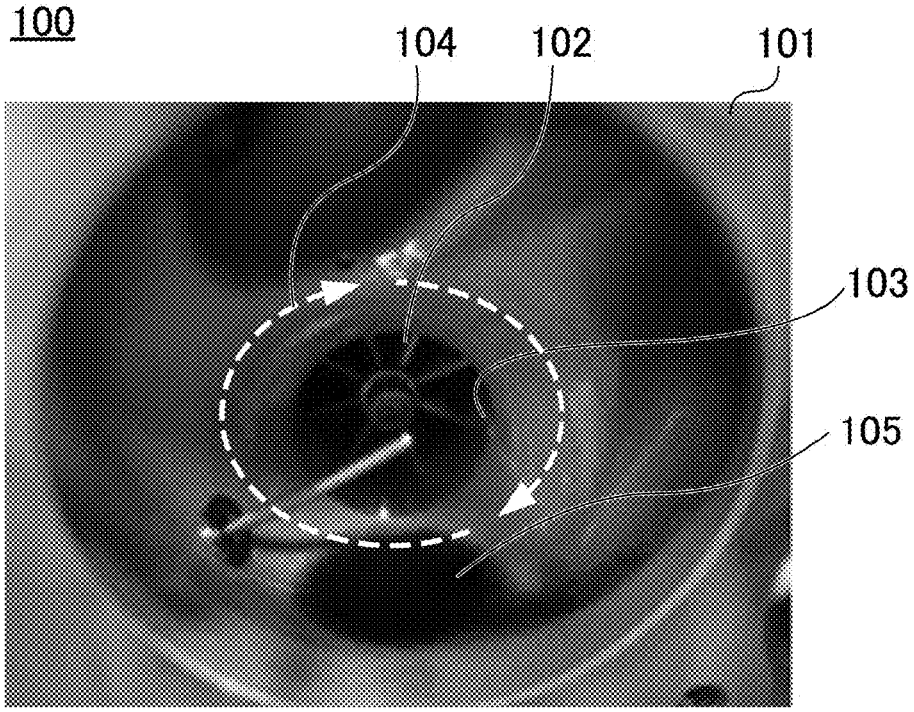
FIG. 10 is a view showing an aspect of the inside of a conventional compressor housing.

Referring back to FIG. 3, at a portion of the inner circumferential face 62 of the intake air duct 6 adjacent to the intake air inlet 22 of a base 64 serving as the bottom, at the equipped orientation of the compressor housing 1, a recess 65 that is lower than the lowest point 221 of the intake air inlet 22 is formed. As explained by referencing FIGS. 9 and 10, swirl flow in the same direction as the rotational direction of the compressor impeller 5 is produced inside of the intake air duct 6 when performing steady operation of the engine. In addition, when such swirl flow is produced, a part of the oil falling down by running along the connecting face 6 which connects the blow-by gas inlet 83 and the intake air inlet 22 (refer to FIG. 2 or 4) may continue to swirl along the shoulder face 63 around the intake air inlet 22, without being aspirated into the intake air inlet 22. The oil swirling around the intake air inlet 22 during steady operation of the engine in this way collects in the recess 65 by way of its own weight when becoming low load operation and the swirl flow weakens.

Figure 5:
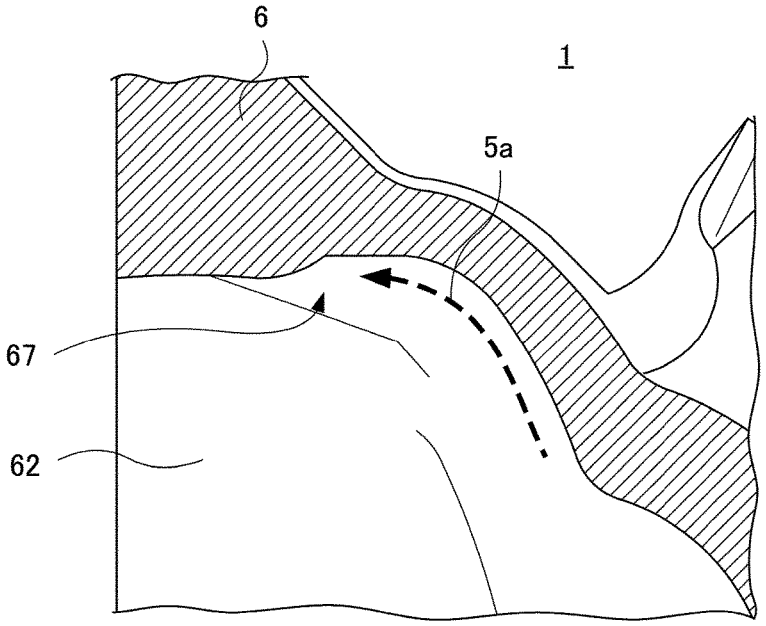
FIG. 5 is a cross-sectional view of the compressor housing according to the embodiment.
Figure 6:
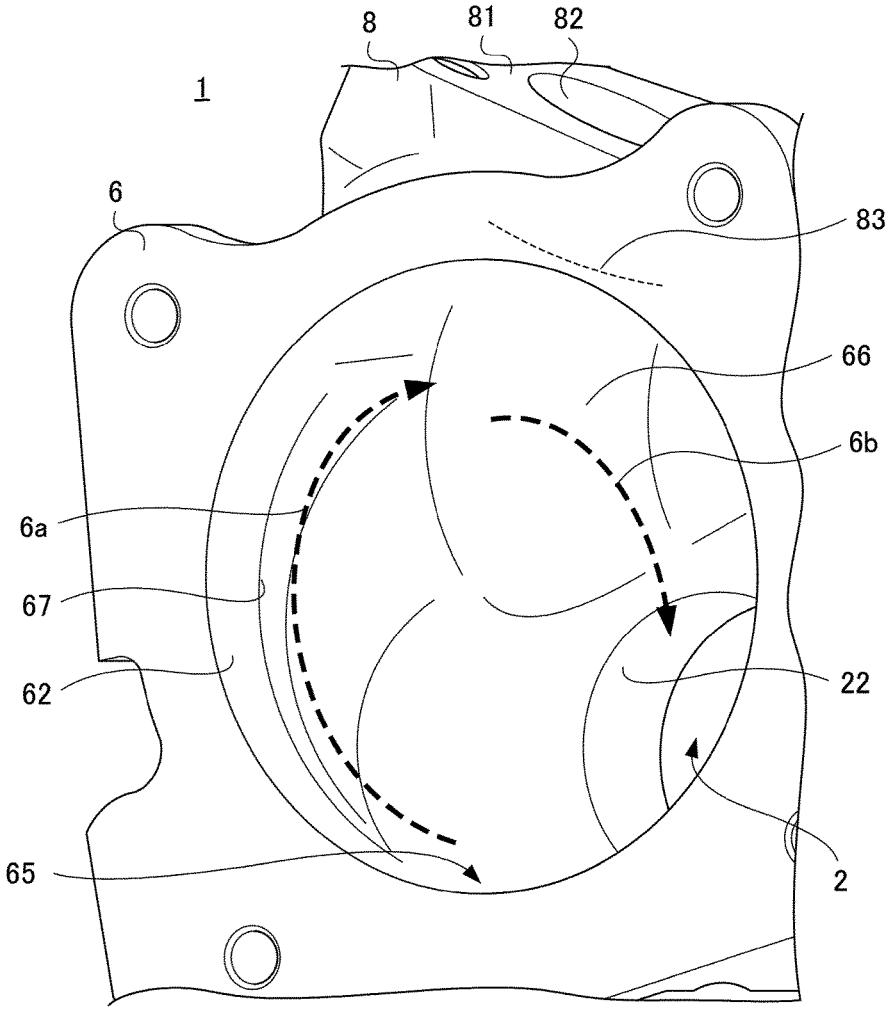
FIG. 6 is a perspective view of the compressor housing according to the embodiment.

FIG. 5 is a cross-sectional view of the compressor housing 1. More specifically, FIG. 5 is a drawing when viewing the cross section of the compressor housing 1 along the line III-III in FIG. 3 in the direction of the arrow A5. FIG. 6 is a perspective view of the compressor housing 1. More specifically, FIG. 6 is a perspective view when viewing a portion on the left side in FIG. 2 of the inner-wall face 61 of the compressor housing 1.

As shown in FIGS. 3, 5 and 6, an arc-shaped step part 67 along the circumferential direction of the compressor impeller 5 is formed in the inner circumferential face 62 more to the upstream side along the axis line C than the recess 65. In addition, the distance along the radial direction of the compressor impeller 5 from the axis line C until the wall face is farther at the downstream side than the upstream side with the step part 67 as the border (refer to FIG. 5). Therefore, this step part 67 serves as a barrier relative to the flow of oil (refer to arrow 5*a* in FIG. 5) running along the inner circumferential face 62 to the upstream side from the recess 65 provided on the downstream side therefrom. It should be noted that the position at which forming the step part 67 is not limited thereto. However, in order to configure so as not to add to the amount of oil collecting in the recess 65, the step part 67 is preferably formed at a portion other than the base 64 in the inner circumferential face 62.

The step part 67 extends along the circumferential direction of the compressor impeller 5 to a side of the blow-by gas inlet 83 provided above in the vertical direction the intake air inlet 22, from a position, which is higher than the lowest point 221 of the intake air inlet 22, on a lateral part in the equipped orientation of the compressor housing 1 of the inner circumferential face 62 of the intake air duct 6.

The effects of this step part 67 will be explained while referencing FIG. 6. First, as explained by referencing FIGS. 9 and 10, surging occurs when stepping on the accelerator pedal, and a strong swirl flow may be produced from the side of the impeller chamber 2 towards the upstream side inside of the intake air duct 6. On this occasion, if oil is collected in the recess 65, the oil having collected in the recess 65 will run along the inner circumferential face 62 of the intake air duct 6 and flow to the upstream side by way of the strong swirl flow in the reverse direction. However, since the step part 67 serves as a barrier relative to the flow of oil running along the such a wall face, the oil blown back due to the reverse swirl flow from the recess 65 will run up to the side of the blow-by gas inlet 83 along the extending direction of the step part 67 as shown by the arrow 6*a* in FIG. 6, i.e. circumferential direction of the compressor impeller. In addition, the oil led until the side of the blow-by gas inlet 83 by the step part 67 arrives at the connecting face 66 that is substantially perpendicular to the axis line C connecting the blow-by gas inlet 83 and the intake air inlet 22 (refer to FIG. 4), and runs along the connecting wall 66 to be aspirated into the intake air inlet 22, as shown by the arrow 6*b* in FIG. 6. According to the step part 67, the blowback to the upstream side of oil collected in the recess 65 is thereby suppressed, and the aspiration of collected oil to the intake air inlet 22 is promoted.

Figure 7:
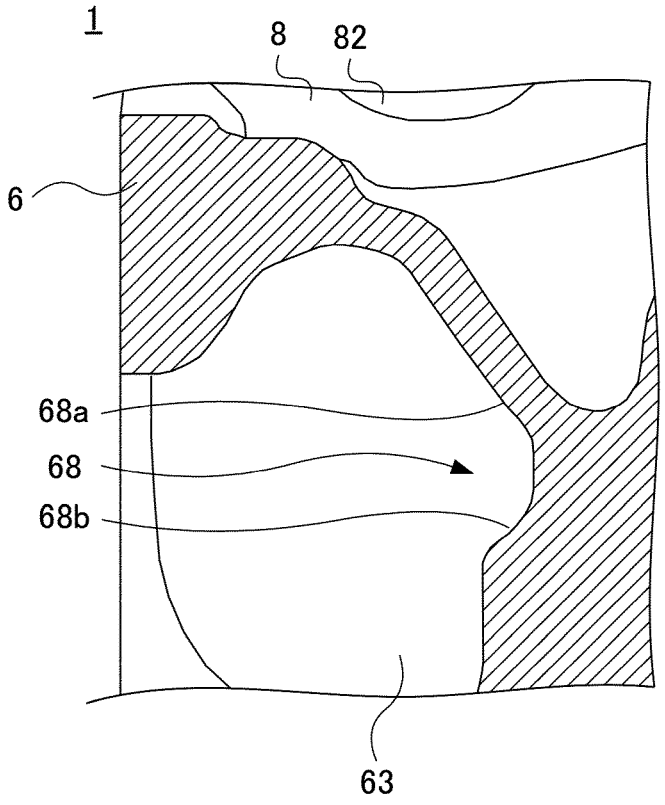
FIG. 7 is a cross-sectional view of the compressor housing according to the embodiment.
Figure 8:
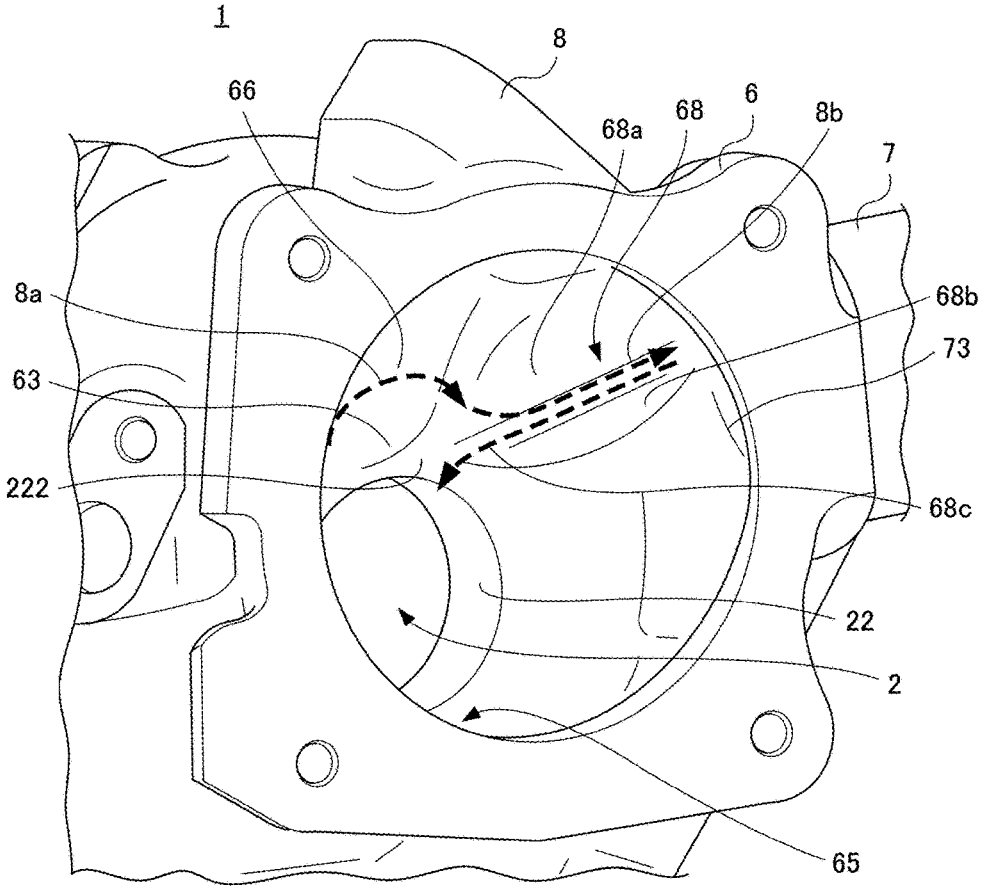
FIG. 8 is a perspective view of the compressor housing according to the embodiment.

FIG. 7 is a cross-sectional view of the compressor housing 1. More specifically, FIG. 7 is a drawing when viewing the cross section of the compressor housing 1 along the line IIb-IIb in FIG. 2 in the direction of the arrow A7. FIG. 8 is a perspective view of the compressor housing 1. More specifically, FIG. 8 is a perspective view when viewing a portion on the right side in FIG. 2 of the inner-wall face 61 of the compressor housing 1.

As shown in FIGS. 2, 7 and 8, a substantially V-shaped groove 68 in a cross-sectional view extending along the radial direction of the compressor impeller 5 from the circumferential edge of the intake air inlet 22 is formed more to the upstream side along the axis line C than the intake air inlet 22 in the shoulder face 63 inside of the intake air duct 6. The groove 68 extends along the radial direction of the compressor impeller 5 from an apex 222 of the circumferential edge of the intake air inlet 22 in the equipped orientation of the compressor housing 1, and reaches the EGR inlet 73 provided at a position higher than the intake air inlet 22 as mentioned above.

The effects of this groove 68 will be explained while referencing FIG. 8. First, as explained by referencing FIGS. 9 and 10, while performing steady operation of the engine, swirl flow is produced from the upstream side to the side of the impeller chamber 2 inside of the intake air duct 6, and oil in the blow-by gas may continue to swirl around the intake air inlet 22 along the shoulder face 63 due to this, whereby the oil may collect in the recess 65 when releasing the accelerator pedal. The groove 68 extends along the radial direction of the compressor impeller 5, and the groove 68 is substantially perpendicular relative to the flowing direction of oil during steady operation. Therefore, at the shoulder face 63 at the inside of the intake air duct 6, for the oil swirling and moving along the circumferential direction of the impeller around the intake air inlet 22 as shown by the arrow 8*a* in FIG. 8, at this groove 68, the traveling direction thereof is changed to the extending direction of the groove 68, i.e. radial direction of the compressor impeller 5, and the oil spreads along both wall faces 68*a*, 68*b* constituting the groove 68 as shown by the arrow 8*b* in FIG. 8. Therefore, according to this groove 68, the oil swirling around the intake air inlet 22 during steady operation can be made to temporarily evacuate without allowing to reach the recess 65 below. In addition, the reference point of the groove 68 as mentioned above serves as the apex 222 of the circumferential edge of the intake air inlet 22 in the equipped orientation. Therefore, the oil temporarily evacuated to the groove 68 by the swirl flow during steady operation, when subsequently releasing the accelerator pedal, runs along the groove 68 by way of its own weight, and flows into the intake air inlet 22 provided therebelow, as shown by the arrow 68*c* in FIG. 8; therefore, it is possible to decrease the amount of oil collecting in the recess 65.

According to the compressor housing 1 of the present embodiment, the following effects are exerted.

(1) The compressor housing 1 forms an arc-shaped step part 67 along the circumferential direction of the compressor impeller 5, more to the upstream side along the axis line C than the intake air inlet 22 in the inner circumferential face 62 of the intake air duct 6 thereof. Since the step part 67 serves as a barrier relative to the flow of oil running along the inner circumferential face 62, even when strong swirl flow is produced from the downstream side towards the upstream side within the intake air duct 6 in a state in which oil has collected in the recess 65 in the vicinity of the intake air inlet 22 within the intake air duct 6, it is possible to suppress oil from overcoming the step part 67 and blowing back further to the upstream side. In addition, it is thereby possible to prevent the air-flow meter 94 provided on the upstream side from the intake air duct 6 from being dirtied by oil.

(2) The compressor housing 1 provides the breather duct 8 extending along the radial direction of the compressor impeller 5, and recirculates blow-by gas from this breather duct 8 within the intake air duct 6. With a conventional compressor housing, when recirculating blow-by gas within the intake air duct of the compressor housing, oil tends to collect within the intake air duct, and the problem of blowback of oil to the intake air upstream side is more remarkably exhibited. In contrast, with the compressor housing 1, since the outward flow of oil to upstream side is suppressed by the step part 67 formed in the intake air duct 6, even if recirculating blow-by gas within the intake air duct 6, the problem of blowback of oil as mentioned above will not actualize.

(3) With the compressor housing 1, the blow-by gas inlet 83 is provided vertically above the intake air inlet 22 in the equipped orientation thereof, and further, the connecting face 66 which connects the blow-by gas inlet 83 and the intake air inlet 22 in the shoulder face 63 of the intake air duct 6 is substantially perpendicular to the axis line C. Since most of the oil in the blow-by gas is thereby flowed into the intake air inlet 22, it is possible to reduce the amount of oil collecting in the recess 65 inside the intake air duct 6, and possible to further suppress blowback of oil.

(4) With the compressor housing 1, the step part 67 is formed more to the upstream side along the axis line C than the recess 65 serving as the bottom in the equipped orientation of the inner circumferential face 62 of the intake air duct 6. It is thereby possible to suppress the outward flow to further upstream side by this step part 67, even if oil collected in the recess 65 is flowed to the upstream side by a strong reverse swirl flow as mentioned above.

(5) With the compressor housing 1, the step part 67 is formed in a portion other than the base 64 of the inner circumferential face 62. It is thereby possible to suppress the outward flow to the upstream side thereof, without increasing the amount of oil collecting in the recess 65 within the intake air duct 6.

(6) With the compressor housing 1, the step part 67 extends along the circumferential direction of the compressor impeller 5 to the side of the blow-by gas inlet 83 provided vertically above the intake air inlet 22 from a position, which is higher than the lowest point 221 of the intake air inlet 22, on a lateral part in the equipped orientation of the inner circumferential face 62. When a strong reverse swirl flow is produced, the oil collected in the recess 65 thereby flows from the side of the base 64 along the step part 67 to the side of the blow-by gas inlet 83 which is vertically above, and runs along the connecting face 66 formed to be substantially perpendicular to the axis line C and flows into the intake air inlet 22. It is thereby possible to flow the oil collected in the recess 65 into the intake air inlet 22, while configuring so as not to blow back to the upstream side.

(7) The compressor housing 1 forms the groove 68 extending along the radial direction from a position, which is higher than the lowest point 221 of the intake air inlet 22 in the equipped orientation, on the circumferential edge of the intake air inlet 22, more to an upstream side along the axis line C than the intake air inlet 22 in the shoulder face 63 of the intake air duct 6 thereof. Since it is thereby possible to temporarily cause the oil swirling around the intake air inlet 22 during steady operation to evacuate to this groove 68, it is possible to reduce the amount of oil collecting in the recess 65 upon releasing the accelerator pedal. It is thereby possible to reduce the amount of oil blown back from the upstream side to the downstream side when a strong reverse swirl flow is produced from the downstream side towards the upstream side inside the intake air duct 6. In addition, it is thereby possible to prevent the air-flow meter 94 provided on the upstream side of the intake air duct 6 from being dirtied by oil.

(8) The compressor housing 1 provides the EGR duct 7 extending along the radial direction of the compressor impeller 5 and introducing EGR gas into the intake air duct 6, and the groove 68 extends from the circumferential edge of the intake air duct 22 to the side of the inner circumferential face 72 of the EGR duct 7. In other words, with the compressor housing 1, it is possible to cause a sufficient amount of oil to evacuate to the groove 68, by providing the groove 68 using the space formed by providing the EGR duct 7.

(9) With the compressor housing 1, the groove 68 extends from the apex 222 of the circumferential edge of the intake air inlet 22 in the equipped orientation to the side of the inner circumferential face of the EGR duct 7. The oil temporarily evacuating to the groove 68 by way of the swirl flow during steady operation, when releasing the accelerator pedal, runs along the groove 68 to flow into the intake air inlet 22 further below; therefore, it is possible to reduce the amount of oil collecting in the recess 65.

Although an embodiment of the present invention has been explained above, the present invention is not to be limited thereto. The detailed configurations may be modified as appropriate within the scope of the gist of the present invention.

In the above-mentioned embodiment, an example is explained in which the rotational direction of the compressor impeller 5 is established as clockwise when viewed from the upstream side; however, the rotational direction of the compressor impeller 5 may be reversed from this.

In the above-mentioned embodiment, an example is explained in which the reference point of the groove 68 is established as the apex 222 in the equipped orientation of the circumferential edge of the intake air inlet 22; however, the present invention is not to be limited thereto. The reference point of the groove 68 may be any portion of the circumferential edge of the intake air inlet 22, so long as being higher than the lowest point 221 of the intake air inlet 22 in the equipped orientation.

What is claimed is:

1. A compressor housing of a compressor that uses an impeller provided in an intake air flow path of an internal combustion engine of a vehicle more to a downstream side than a blow-by gas recirculation part in which blow-by gas of the internal combustion engine recirculates, to pressurize intake air flowing through the intake air flow path, the compressor housing comprising:

an impeller chamber that houses the impeller to be rotatable, and an intake air duct that extends along an axis line of the impeller and introduces intake air to the impeller chamber, and a breather duct that extends in the radial direction of the impeller and introduces blow-by gas into the intake air duct, wherein the intake air duct includes an inner-wall face that connects with an intake air inlet formed in the impeller chamber, wherein a step part that is arc shaped along a circumferential direction of the impeller and has a distance along the radial direction of the impeller from the axis line that is farther at a downstream side than at an upstream side thereof is formed in the inner-wall face more to an upstream side along the axis line than the intake air inlet, wherein a blow-by gas inlet connecting an inner circumferential face of the breather duct and the inner-wall face is provided vertically above the intake air inlet in a state where the compressor housing is mounted on the vehicle, and wherein the blow-by gas inlet is provided in the intake air flow path more to a downstream side than the step part.

2. The compressor housing according to claim 1, wherein a connecting face in the inner-wall face that connects the blow-by gas inlet and the intake air inlet is substantially perpendicular relative to the axis line.

3. The compressor housing according to claim 1, wherein a recess is formed in the inner-wall face at a portion between the intake air inlet and the step part of a base serving as a bottom in a state where the compressor housing is mounted on the vehicle, and wherein the step part is formed more to an upstream side along the axis line than the recess.

4. The compressor housing according to claim 1, wherein a recess is formed in the inner-wall face at a portion between the intake air inlet and the step part of a base serving as a bottom in a state where the compressor housing is mounted on the vehicle, and wherein the step part is formed more to an upstream side along the axis line than the recess.

5. The compressor housing according to claim 2, wherein a recess is formed in the inner-wall face at a portion between the intake air inlet and the step part of a base serving as a bottom in a state where the compressor housing is mounted on the vehicle, and wherein the step part is formed more to an upstream side along the axis line than the recess.

6. The compressor housing according to claim 3, wherein the step part is formed in the inner-wall face at a portion other than the base.

7. The compressor housing according to claim 4, wherein the step part is formed in the inner-wall face at a portion other than the base.

8. The compressor housing according to claim 5, wherein the step part is formed in the inner-wall face at a portion other than the base.

9. The compressor housing according to claim 2, wherein the step part extends along the circumferential direction to a side of the blow-by gas inlet from a position, which is higher than a lowest point of the intake air inlet, on the inner-wall face at a lateral part in a state where the compressor housing is mounted on the vehicle.

10. The compressor housing according to claim 5, wherein the step part extends along the circumferential direction to a side of the blow-by gas inlet from a position, which is higher than a lowest point of the intake air inlet, on the inner-wall face at a lateral part in a state where the compressor housing is mounted on the vehicle.

11. The compressor housing according to claim 8, wherein the step part extends along the circumferential direction to a side of the blow-by gas inlet from a position, which is higher than a lowest point of the intake air inlet, on the inner-wall face at a lateral part in a state where the compressor housing is mounted on the vehicle .

12. The compressor housing according to claim 1, further comprising a groove extending along the radial direction of the impeller from a position, which is higher than a lowest point of the intake air inlet, on a circumferential edge of the intake air inlet that in a state where the compressor housing is mounted on the vehicle, is formed in the inner-wall face more to an upstream side along the axis line than the intake air inlet.

13. The compressor housing according to claim 12, further comprising a recirculation duct that extends along a radial direction of the impeller and introduces blow-by gas or exhaust gas into the intake air duct, wherein the groove extends from a circumferential edge of the intake air inlet to a side of an inner circumferential face of the recirculation duct.

14. The compressor housing according to claim 13, wherein a recirculation opening that connects the inner circumferential face of the recirculation duct and the inner-wall face is provided at a position higher than the intake air inlet in a state where the compressor housing is mounted on the vehicle, and wherein the groove extends from a circumferential edge top part of the intake air inlet to a side of the inner circumferential face of the recirculation duct.

* * * * *